US005498825A

United States Patent [19]

Stahl

[11] Patent Number: 5,498,825

[45] Date of Patent: Mar. 12, 1996

[54] PLUTONIUM AND NUCLEAR TOXIC WASTE STORAGE DEPOT AND METHOD

[76] Inventor: Joel S. Stahl, 530 E. Central Blvd., Apt. 1504, Orlando, Fla. 32801

[21] Appl. No.: 184,859

[22] Filed: Jan. 21, 1994

[51] Int. Cl.[6] ..... G21F 9/00

[52] U.S. Cl. ..... 588/16; 376/287; 376/288; 405/128; 250/506.1; 250/518.1; 250/517.1; 250/515.1; 976/DIG. 157; 976/DIG. 165

[58] Field of Search ..... 588/1, 16; 250/506.1, 250/517.1, 515.1, 518.1; 976/DIG. 157, DIG. 165; 376/287, 288; 405/128

[56] References Cited

U.S. PATENT DOCUMENTS

| | | | |
|---|---|---|---|
| 3,962,080 | 6/1976 | Dulin et al. | 210/59 |
| 4,122,203 | 10/1978 | Stahl | 428/309 |
| 4,142,912 | 3/1979 | Young | 106/98 |
| 4,447,734 | 5/1984 | Kusumegi et al. | 280/517.1 |
| 4,576,513 | 3/1986 | Lindörfer et al. | 405/128 |
| 4,692,061 | 9/1987 | Lindorfer et al. | 405/128 |
| 4,875,805 | 10/1989 | Gross | 405/128 |
| 5,276,255 | 1/1994 | Stark | 588/257 |
| 5,304,705 | 4/1994 | Himmelheber | 588/252 |

*Primary Examiner*—Ngoclan Mai
*Attorney, Agent, or Firm*—Renner, Otto, Boisselle & Sklar

[57] ABSTRACT

A method of removing radioactivity from the interior of a building by transporting radioactive material within a slurry, precipitating out or otherwise filtering out the then contaminated material outside the building, thus removing it in a continuous fluid recirculation system, and storing the precipitated out material while providing shielding of radiation, thereby to provide radiation protection without requiring conventional large mass to block the radioactivity. A toxic waste storage facility includes a building having a portion located below ground level, walls for bounding an interior space in the building, and recirculating fluid for removing thermal energy from the building and for providing radioactive shielding and absorption at least at part of the roof of the building.

27 Claims, 5 Drawing Sheets

PLUTONIUM AND NUCLEAR TOXIC WASTE STORAGE DEPOT AND METHOD

TECHNICAL FIELD

The present invention relates generally, as is indicated, to a plutonium and nuclear toxic waste storage depot and method and, more particularly, to a facility and a method for storing plutonium and nuclear toxic waste material by using a recirculating system in addition to a massive structure that is economically feasible. The invention also relates to encasement of asbestos, lead and other toxic waste by an encasing material that includes a resin and epsom salt, such as that sold under the trademark STAYTEX®, for disposal in ordinary land fills Cross reference is made to copending, commonly owned U.S. Patent application Ser. No. 08/064,548, filed May 19, 1993, entitled Environmental Non-Toxic Encasement Systems for Covering In-Place Asbestos and Lead Paint, the entire disclosure of which hereby is incorporated by reference. Cross reference also is made to U.S. Pat. No. 4,122,203, the entire disclosure of which also hereby is incorporated by reference.

BACKGROUND

The storage of plutonium and nuclear toxic waste is becoming evermore a problem. A problem with plutonium and other nuclear waste is the need to store such waste for a very long time in view of the relatively long half-life of such material. For example, some nuclear waste material have a halfolife that is more than 100 years. Substantial exposure to nuclear material can be a health hazard and, in fact, can be fatal.

One technique for storing plutonium and other nuclear waste has been to place the waste in a container and to bury the container. (Hereinbelow, reference to nuclear waste includes plutonium as well as other nuclear materials, especially those which emit nuclear radiation.) A disadvantage to this technique is the possibility that the container can rust or otherwise corrode, and the nuclear waste can leak. For example, if the nuclear waste were to leak into the ground, it could contaminate the ground water and eventually cause harm to animals, fish, vegetable life, and possibly to humans. Another disadvantage is that the radiation from the nuclear waste can too easily be emitted into the external environment causing a health hazard, for example.

One technique for shielding nuclear waste has been to provide several inches, for example, at least three inches of lead shielding, to surround the nuclear waste. Such lead shielding tends to prevent the transmission of radiation to the external environment. Another technique has been to use at least three feet of water placed between the nuclear waste and the external environment to prevent transmission of radiation to the external environment.

Storage of non-radioactive toxic waste also presents problems similar to those encountered with the storage of toxic nuclear waste. For example, if the toxic waste were placed in drums and buried, leakage due to rusting or corrosion can cause contamination of drinking water and other waters used by fish, animals and plant life.

A difficulty encountered when storing toxic waste, whether nuclear or non-radioactive, is the heat often generated during storage. Excessive heat can trigger undesirable reactions, including the possibility of explosive activity.

This, of course, is undesirable, as it tends to result in a release of the toxic waste to the external environment.

One reason that nuclear waste has been buried in the ground in the past has been the good shielding provided by the ground. Also, prior above ground shelters considered for storing nuclear and other toxic waste contemplate or use concrete and metal wall and roofs; the heavy weight of the roof makes design and construction difficult and sturdiness of the structure questionable. If such structures are used, of necessity they must be small. Today there is no way permanently or substantially permanently to store large quantities of plutonium. Since 1988 over $20 billion has been spent by the U.S. Department of Energy for disposing of nuclear waste; but there has been no improvement in methods and techniques according the Secretary of the Department of Energy. However, when using the ground for shielding, a problem is encountered in the case of a spillage, leak, etc. of the primary containment medium, such as a metal drum or the like.

Encasement using STAYTEX® material can be used for asbestos, lead, etc. for disposal in ordinary landfills. An example of such encasement is described in commonly owned pending U.S. patent application Ser. No. 08/064,548 filed May 19, 1993.

With the foregoing in mind, it will be appreciated that improvements in storage of toxic waste, both of the nuclear type and the non-radioactive type are desired.

SUMMARY

An aspect of the invention relates to the use of a fluid material, such as a slurry, which contains a material intended to receive and to collect nuclear radiation, while preferably also blocking transmission of the nuclear radiation, and precipitating out such material from the fluid material for subsequent storage of the precipitated material.

An exemplary material contained in the fluid or slurry mentioned in the preceding paragraph is epsom salt; and, therefore, an aspect is the use of epsom salt as summarized in the preceding paragraph.

Another aspect of the invention relates to a toxic waste storage depot where toxic waste can be stored, including a building have a portion located below ground, walls for bounding an interior space in the building, and fluid for removing thermal energy from the building and for providing radioactive shielding, at least as a part of the building.

According to .another aspect of the invention, a toxic waste storage depot uses the shielding effect of the ground to tend to prevent leakage of radiation in combination with a fluid of specific gravity characteristics greater than those of water to provide both radioactive shielding and thermal energy removal functions.

A further aspect relates to the use of fluid, such as water, in combination with epsom salt or $MgSO_4.7H_2O$ to provide relatively high specific gravity slurry material to effect radiation shielding and thermal energy removal from a toxic waste storage facility.

An aspect of the invention relates to a method of effecting radiation shielding and thermal energy removal from a toxic waste storage facility including using water in combination with epsom salt to provide relatively high specific gravity slurry material to block transmission of radiation and to remove thermal energy.

Another aspect relates to a method of removing radioactivity from the interior of a building by transporting radioactive material within a slurry and filtering out the then contaminated material outside the building, thus removing it in a continuous fluid recirculation system.

A further aspect relates to a toxic waste storage facility including a building having a portion located below ground level, walls for bounding an interior space in the building, and fluid for removing thermal energy from the building and for providing radioactive shielding at least at part of the roof of the building.

An additional aspect relates to a toxic waste depot method including using the shielding effect of the ground to tend to prevent leakage of radiation in combination with a fluid of specific gravity characteristic greater than that of water to provide both radioactive shielding and thermal energy removal functions.

Yet another aspect relates to a method of disposing of toxic material, such as asbestos, lead, and the like, including encasing the toxic material in a cured resin system including at least one liquid thermosetting resin having particulate solids dispersed therein, about 100% of the solids having a U.S. Standard mesh size of about 225 mesh or smaller and at least about 10% of the solids having a U.S. Standard mesh size of about 325 mesh or smaller, wherein the solids comprise crystalline hydrated inorganic salts, and placing the encased material in a conventional land fill.

These and other objects, aspects, features and advantages of the present invention will become more apparent as the following description proceeds.

To the accomplishment of the foregoing and related ends, the invention, then, comprises the features hereinafter fully described and particularly pointed out in the claims. The following description and the annexed drawings setting forth in detail a certain illustrative embodiment of the invention. This embodiment is indicative, however, of but one of the various ways in which the principles of the invention may be employed.

Although the invention is shown and described with respect to a certain embodiment, it is obvious that equivalents and modifications will occur to others who have ordinary skill in the art upon reading and understanding the specification. The present invention includes all such equivalents and modifications and is limited only by the scope of the claims.

DESCRIPTION

Figure 1:
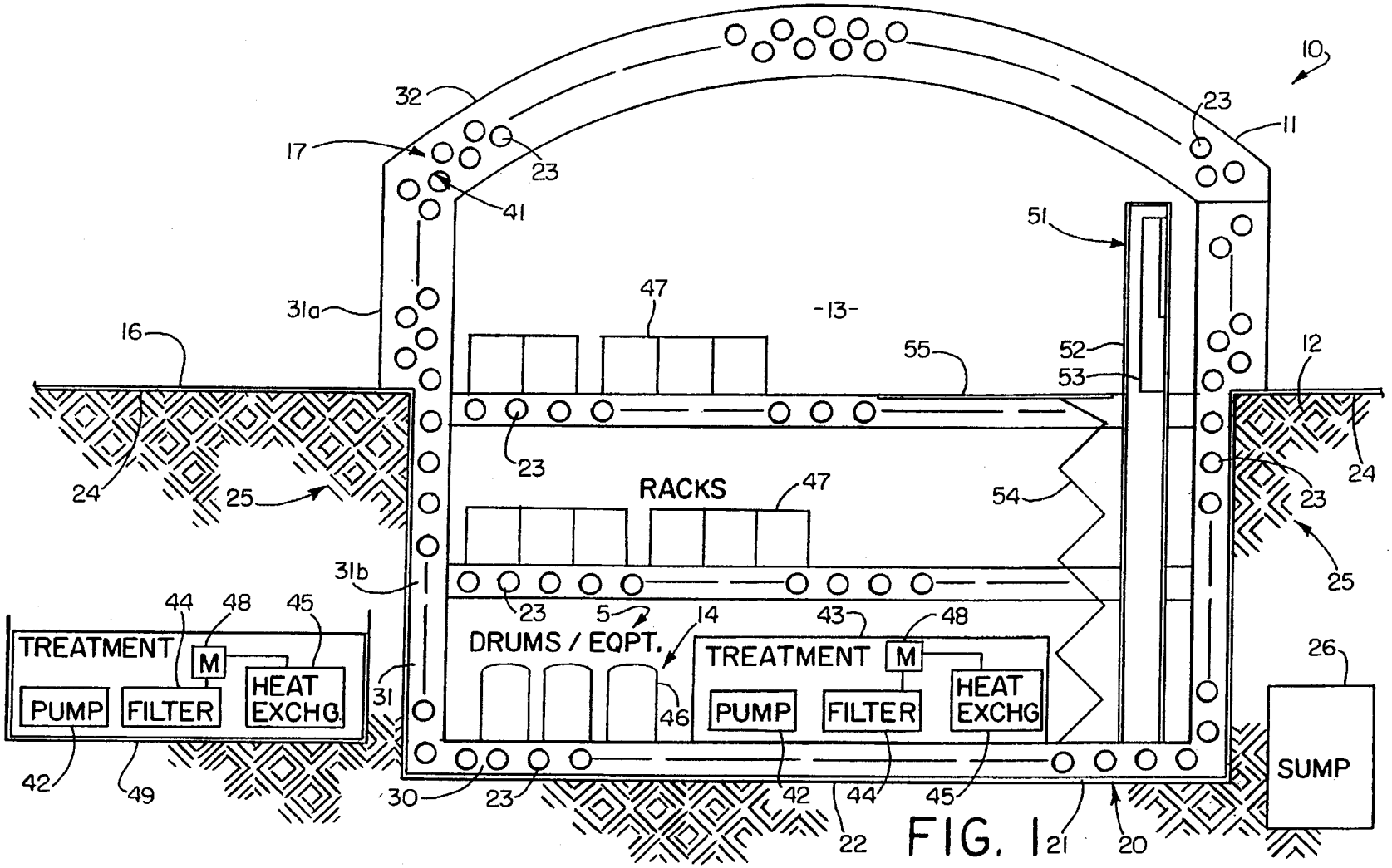
FIG. 1 is a schematic side elevation section view of a plutonium and nuclear toxic waste storage depot in accordance with the present invention.

Referring to the drawings, wherein like reference numerals designate like parts in the several figures, and initially to FIG. 1, a toxic waste depot in accordance with the present invention is generally indicated at 10. The depot 10 is in the form of a building 11 that is located at least partly in the ground 12. The building 11 has an interior space 13 in which waste material 14 may be stored in a storage location 15. The storage location 15 preferably is located well below the surface 16 of the ground 12 in order to take advantage of the radiation shielding capability of the ground. Part of the storage location near ground level or above ground level may be used for toxic non-radioactive material, such as asbestos encased in STAYTEX® material. The building 11 also includes a fluid flow system generally designated 17 through which a fluid is conducted. The fluid is intended to provide both radiation shielding effect when necessary, and thermal energy removal, as is described in greater detail below. Also, the fluid provides for relatively easy removal and convenient storage of radiation-containing or radiation contaminated material therefrom.

The toxic waste depot 10 includes a large hole or open pit opening 20 formed in the ground 12. Preferably adequate clearance and thickness of ground material, earth, etc. is located around the large hole 20 to provide adequate support for the building 11 and adequate shielding for radioactive energy. It has been found in the past that three feet of dirt often is adequate to provide satisfactory shielding of radiation. Additional thickness may be required in some circumstances; and possibly a thinner layer also may be adequate, depending on circumstances. There should be adequate support capability by the ground 12, including the base 21 of the large hole 20 to support the building 11. If necessary, additional footers (not shown) may be used to provide the desired support. Also, pipes 23 in the walls and roof of building 11 provide reinforcement to help make them structural.

The large hole 20 is lined by a liner 22. An exemplary liner 22 may be of heavy duty plastic or rubber material used conventionally to line the bottom of convention toxic waste storage facilities. The liner 22 should have adequate strength to avoid tearing, and it should have adequate fluid impermeability characteristics to avoid leakage. An exemplary liner material is that sold by Reef Industries, Inc. of Houston, Tex. under the designation of PERMALON PLY X-210. Preferably the liner 22 extends side-wise beyond the building 11 a distance adequate to tend to prevent water from the directly flowing into the ground 12 directly adjacent the building 11. Such side-wise extensions 23, 24 protecting the ground areas 25, 26, respectively are seen in FIG. 1. Such extensions 23, 24 preferably fully circumscribe the building 11 for the described purpose, and by preventing water flow adjacent the sidewalls of the building 11, the tendency of the water to become radioactive and to leak into the water table and other water supplies is reduced. A catch basin and/or sump 26 may be provided outside the building 11 to collect material from an emergency spill; a pump may be provided to pump such collected material for further treatment, storage and/or disposal.

The building 11 has a floor 30, sidewalls 31, and a roof 32. The top plan view of the building 11 may be circular, rectangular, hexagonal, or some other shape, depending on the shape of the large hole 20, the layout of the sidewalls 31, etc. The exposed above ground portion 31*a* of the sidewalls 31 and the roof 32 preferably are adequately thick to contain at least a portion of the fluid flow system 17. The below ground level portion 31*b* of the sidewalls 31 may be thinner than the portions 31*a*, as it may be unnecessary to have fluid flow system 17 therein or the extent of such fluid flow system therein may be less than is required in the portion 31*a* and roof 32. Specifically, since the fluid flow system 17 provides both radioactive energy shielding and thermal energy removing function, for the portion of the fluid flow system 17 that is not within the ground 12, a larger capacity of fluid is required. However, for that portion of the building 11 within the ground 12, radioactive energy shielding is provided at least in part by the ground itself, and, therefore, the extent of need for shielding provided by the fluid flow system 17 is reduced. However, it may be that some shielding is desired by the fluid flow system 17 in the below ground portion 31*b* of the sidewalls 31, and it also may be that thermal energy removal is desired in the portion 31*b*, too. The floor 30 is well below the surface 16 of the ground 12, and, therefore, shielding function of the fluid flow system 17 also may be unnecessary there. However, it may be desirable to have thermal energy removal function provided by the fluid flow system 17 in the floor 30.

The building 11 preferably is several stories tall including about one story located above ground and several stories located below ground surface level, for example, at least three stories below ground. Each floor is made of structural prefabricated panels that are the right weight light weight compared to heavy concrete panels. The floor panels also include pipes in them to provide structural capability. The pipes are intended to carry the slurry described below to provide further shielding function. Since shielding is provided by the floors intermediate the bottom floor and the roof, the shielding function or burden required to be provided by the roof is reduced; and this reduces the thickness and other size and structure requirements of the roof. Such structure takes advantage of the shielding capacity of the ground 12 and also can take advantage of the support provided by the ground 12 reinforcing the sidewalls 31*b* located within the hole 20. The sidewalls 31 provide support for the roof 32. The sidewalls 31 and the floor 30 provide containment for the solid and liquid materials in the space 13 of the building 11. Furthermore, the sidewalls 31, floor 30 and roof 32 may include space to contain part of all of the fluid flow system 17. For example, a plurality of pipes may be located in the walls, floor and/or roof to conduct a slurry through the pipes for the described purpose of shielding and thermal energy removal. Pipes 23, also provide the structural integrity of the walls and roof. Concrete is too heavy for practical use for large structures (buildings) that are capable of reactivity shielding. Three feet or other relatively large thickness of concrete is needed to provide adequate shielding would be so heavy that it would be difficult at best, and in cases impossible, to provide adequately strong side walls and reinforcement in the roof to support such a concrete roof.

The walls 31, floor 30, and roof 32 may be formed of various materials. Preferably, though, the walls, floor and roof are formed in part by a material sold under the U.S. Registered Trademark STAYTEX®. An example of such STAYTEX® materials and methods of using it are disclosed in U.S. Pat. No. 4,122,203. Additional description of such material and methods of using it are described in copending, commonly owned U.S. patent application Ser. No. 08/064,548, filed May 19, 1993, entitled Environmental Non-Toxic Encasement Systems for Coveting In-Place Asbestos and Lead Paint. The STAYTEX® material may provide both facing or surfacing functions as well as sealing functions. The STAYTEX® material may be sprayed onto joints between pre-fabricated panels making up the sidewalls 31, floor 30, or roof 32, for example, in the manner illustrated in FIG. 2.

Figure 2:
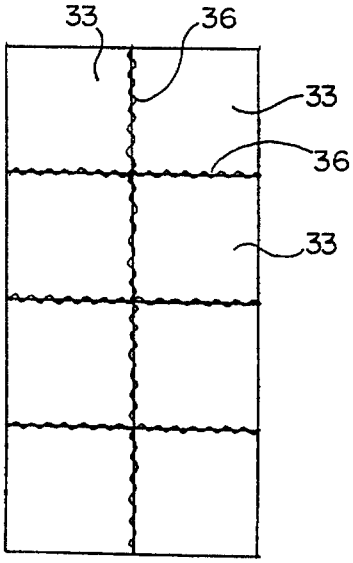
FIG. 2 is a schematic illustration of an area of the sidewall of the depot building of FIG. 1.
Figure 3:
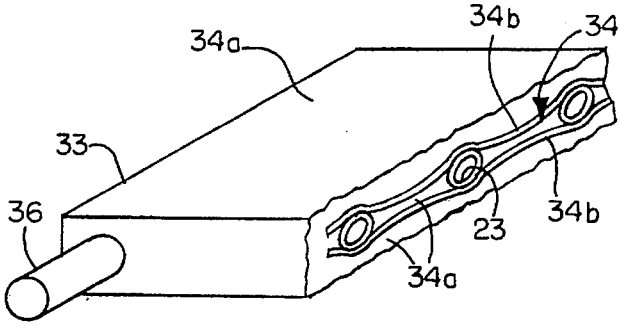
FIG. 3 is a schematic isometric view, partly in section, of a wall, floor, or ceiling panel used in the depot building of the invention.
Figure 5:
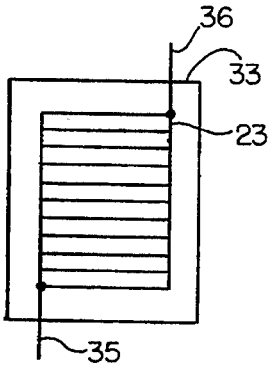
FIGS. 4 and 5 are schematic plan views of the panel of FIG. 3 showing series and parallel piping arrangements, respectively.
Figure 4:
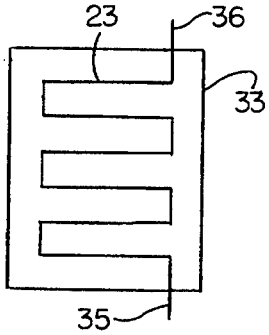

Briefly referring to FIG. 2, a plurality of pre-fabricated wall panels 33 are illustrated. The panels may be made of the following materials and/or by the following methods.

An exemplary wall panel 33 is illustrated in FIGS. 3–7. The wall panel 33 includes pipes 23, for example of steel, polyvinyl chloride (pvc), or other metal, plastic material or other synthetic or natural material. A core material 34 of a panel is made of the mentioned STAYTEX® material 34*a*, preferably in combination with fiberglass sheets 34*b*. The STAYTEX® material can be molded or extruded relative to the pipes to form therewith an integral structure. The fiberglass may provide reinforcement and a base to which the STAYTEX® material easily can adhere.

Figure 8:
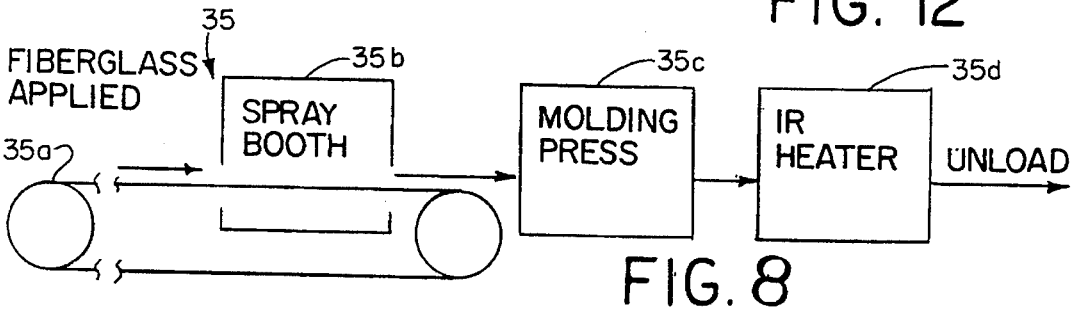
FIG. 8 is a schematic view of a process line for making panels of the invention.

An exemplary manufacturing line 35 to manufacture the panels 33 is illustrated schematically in FIG. 8. To make a panel, the pipes 23 are connected in the manner desired for structural and fluid carrying purposes. The fiberglass sheets 34*b* are placed relative to pipes 23 on a conveyor 35*a* for carrying to a spray booth 35*b* and then to a mold 35*c*. The STAYTEX® material is applied to the pipes and fiberglass, e.g., in the spray booth 35*b* to make an integral structure thereof, particularly after the STAYTEX® material has cured to solid relatively rigid form. The STAYTEX® material may be applied by spraying, troweling, roller coating, etc. The panel may be heated at the infrared heater 35*d* to complete or to expedite curing. The panels may be shaped during molding by using a specifically shaped mold and/or molding press 35*d* to shape the panel during the formation of the panel.

The pipes 23 may be arranged in a plurality of horizontal or vertical rows or in some other pattern in the panel 33. The pipes 23 may be connected for serial flow (see FIG. 4) of slurry through a panel; they may be connected for generally parallel flow (see FIG. 5) of slurry through a respective panel 33 or through plural panels (the latter case being where plural pipes of one panel are connected to plural pipes of another panel). One or more nipples 36 or other pipe connectors is exposed from each panel for connection to the flow system of the invention, i.e., to the pipes in another panel, to another portion of the flow system, etc.

Figure 6:
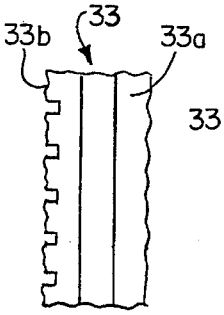
FIG. 6 is a schematic edge elevation view of such panel having concrete and brick facing material on respective faces thereof.
Figure 7:
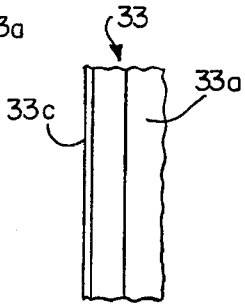
FIG. 7 is a schematic edge elevation view of such panel having concrete and metal facing material on respective faces thereof.

The wall panels, floor panels and roof panels may be identical. Where needed, additional facing or skin material to prevent damage to the panels and/or to provide particular characteristics to the panels may be used. Exemplary outer skin material include steel, brick, various natural and/or synthetic materials, composite materials, etc. In FIG. 6 is illustrated schematically a panel 33 with concrete facing material 33*a*, e.g., for contact with the earth of the large hole 20, and with brick facing material 33*b*, e.g., for exposure inside the building 11, say as the inside wall or top surface of a floor on which a vehicle easily may travel. In FIG. 7 is illustrated schematically a panel 33 with concrete facing material 33*a*, e.g., for contact with the earth of the large hole 20, and with steel facing material 33*c*, e.g., for exposure inside the building 11.

At the seams 36 between adjacent panels 33 STAYTEX® material may be applied, for example, by spraying, troweling, roller coating, etc. to seal the joints. The STAYTEX® material also may be used to provide a sealing function between the sidewalls 31 and the floor 30 and/or roof 32 as well as between other portions of the overall structure of the building 11.

Referring to the fluid flow system 17, a plurality of pipes 23 are located in the roof 32, in the sidewalls 31, including both the portions 31*a*, 31*b*, and in the floor(s). A liquid slurry 41 flows through the pipes 23, preferably being pumped therethrough by pumping equipment 42. The pumping equipment may include one or more standard water pumps, outside the building 11, either above ground, in ground, for example in a sump 42, and/or in a treatment system 43 located in the space 13 of the building 11 and/or outside the building. There may be one or more treatment systems and/or parts thereof, and each may be located inside or outside building 11. The sump 42 may be separate from, the same as, or a part of the sump or catch basin 26. A filter system 44 also is provided in the treatment system 43 to filter excessive radioactive material from the slurry 41, to filter other particular material from the slurry 41, and to provide such removed material to a storage container 46 for storage in the storage area 15.

The slurry 41 in the pipes 23 preferably has a relatively high specific gravity compared to the specific gravity of water, which is 1. Exemplary relatively high specific gravity is from about 1.2 to about 1.6. Other relatively high specific gravities also may be used for the slurry 41. A specific gravity of 1.6 is obtainable by making a slurry of water and a relatively high concentration of epsom salt, as is elsewhere described herein. A slurry of water and boron also may be used.

Figure 9:
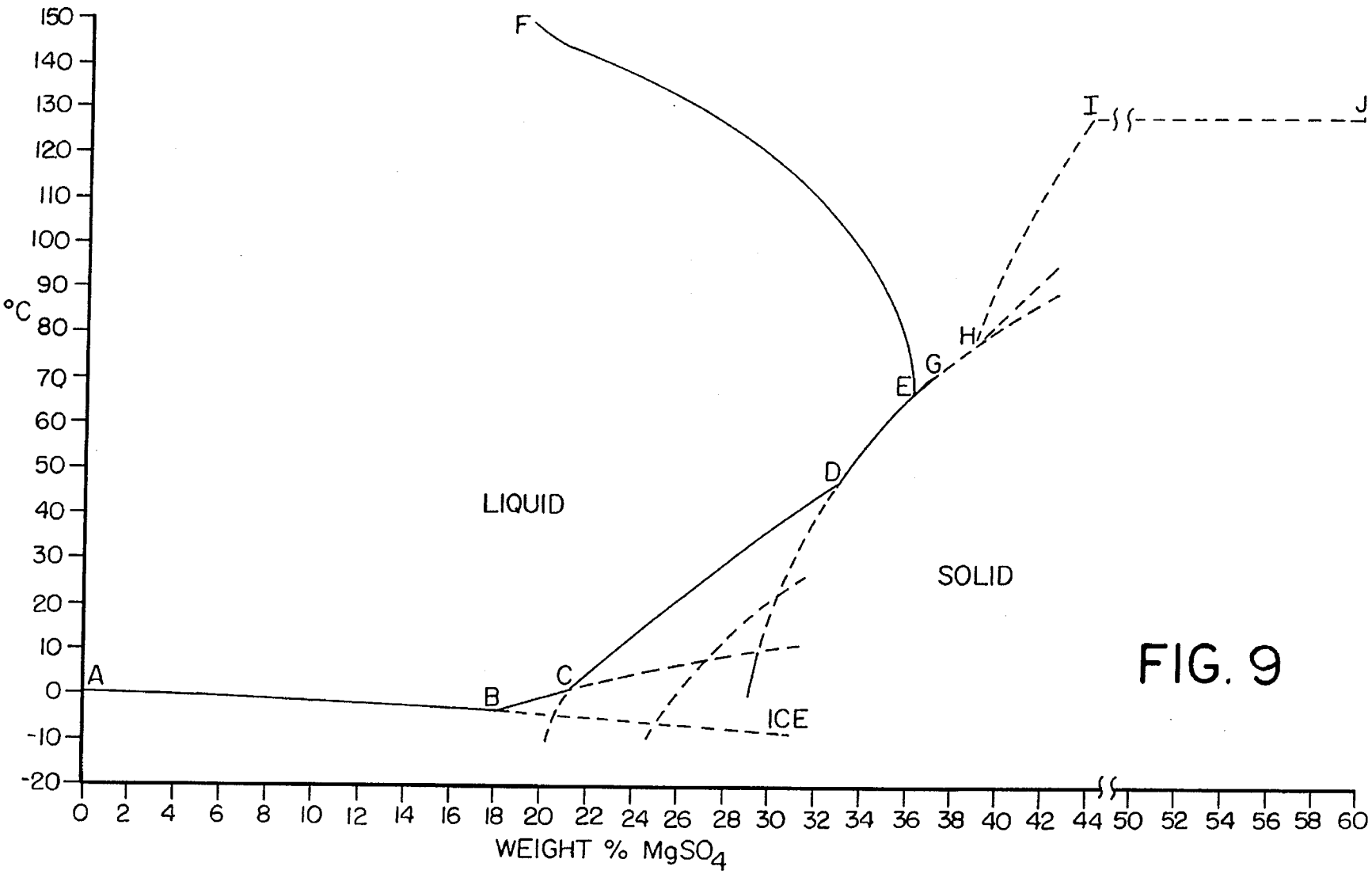
FIGS. 9, 10 and 11 are respective graphs identifying characteristics of a slurry material of water and epsom salt used in accordance with the invention.

FIG. 9 is a graph showing the solubility of $MgSO_4$ in $H_2O$ and is taken from Gmelins, page 218, M. Polo, et al., and C. R. Acad. Sci., Ser C. 1971, 272 (7), 642. The lines in the graph of FIG. 9 have several alphabet letters thereon, and such lines between respective alphabet letters represent solid phases and transition points, as follows:

AB: Ice

B: −3.9° C., 18% $MgSO_4$ (Eutectic)

BC: $MgSO_4.12H_2O$

C: 1.8° C., 21.4% $MgSO_4$

CD: $MgSO_4.7H_2O$

D: 48.3° C., 33.1% $MgSO_4$

DE: $MgSO_4.6H_2O$ (Gmelins)

E: 67.5° C., 36.1% $MgSO_4$

EF: $MgsO_4.H_2O$ (Gmelins)

DG: $MgSO_4.6H_2O$ (Polo et al.)

G: 70° C., 36.8% $MgSO_4$

GH: $MgSO_4.4H_2O$ (Polo et al.)

H: 78° C., 38.8% $MgSO_4$

HI: $MgSO_4.H_2O$ (Poloet al.)

I: 130° C., 44% $MgSO_4$

IJ: Mg $(OH)_2$ Formation (Polo et al.)

Figure 10:
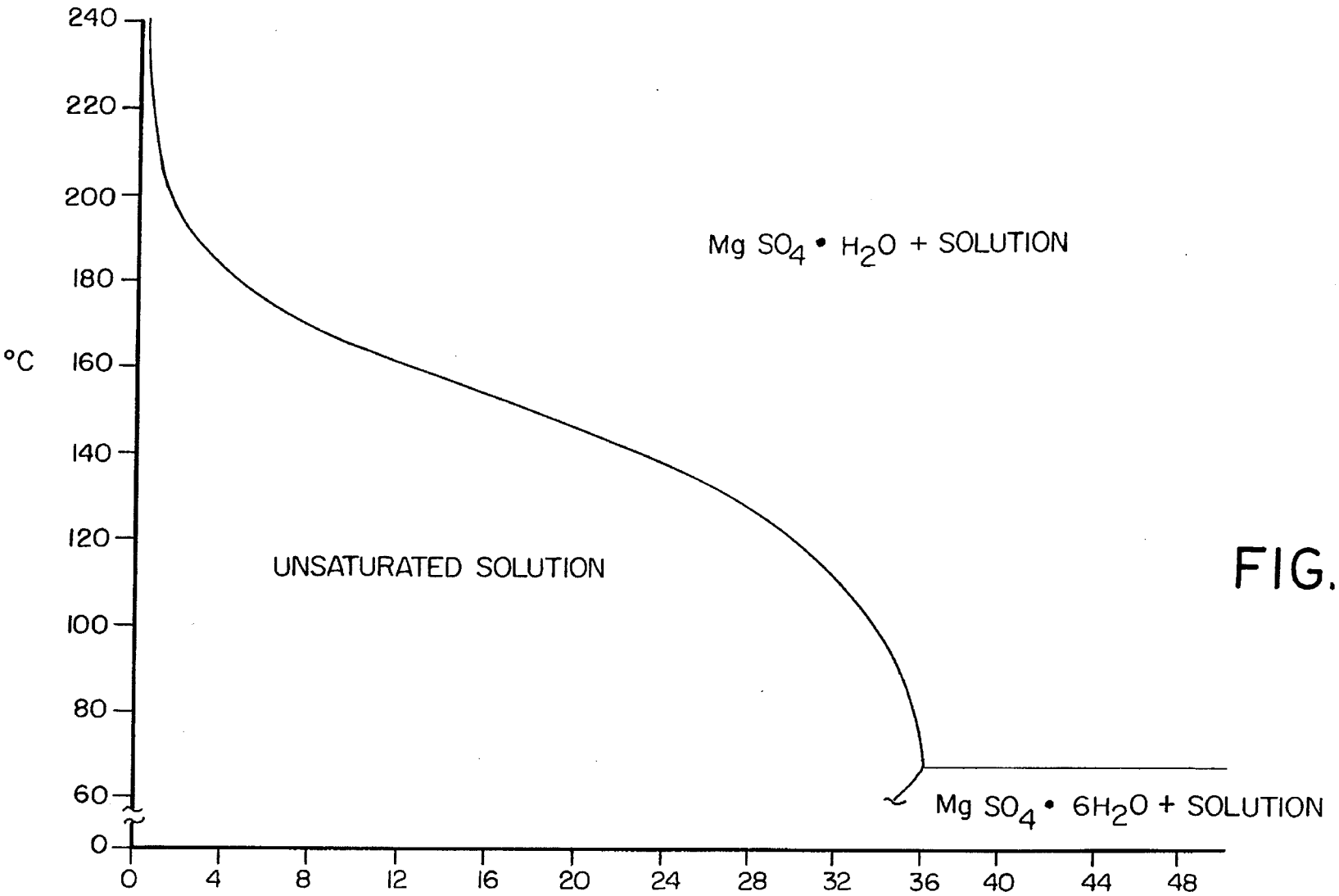

FIG. 10 is a graph showing the solubility of $MgSO_4$ at elavated temperatures and is taken from Gmelins, page 222. The transition point at the junction of the several lines shown in the graph of FIG. 10 is at 67.5° C., and 36.1% $MgSO_4$.

Figure 11:
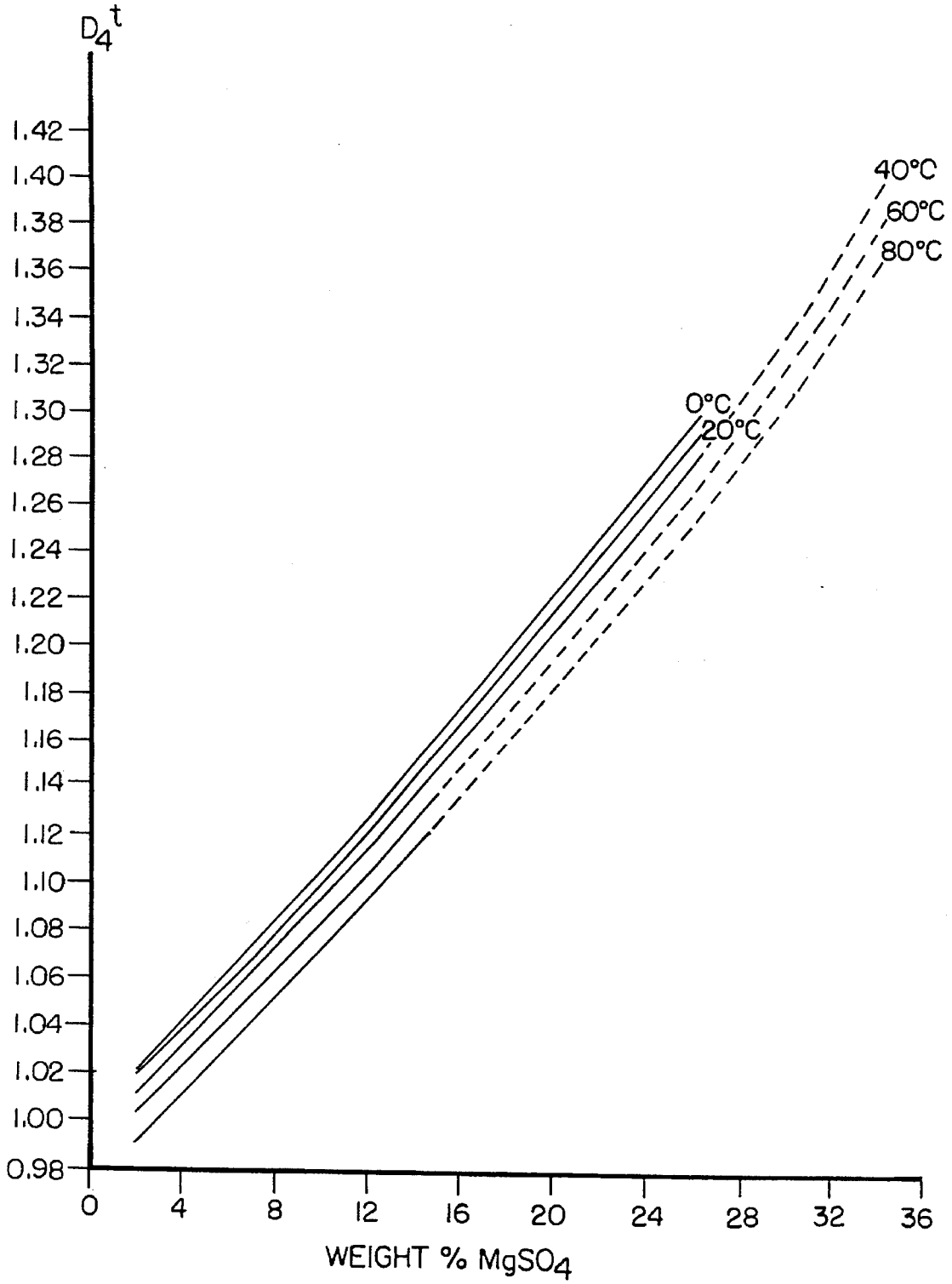

The graph of FIG. 11 presents the density of $MgSO_4$ solutions. The solid lines in the graph are taken from Gmelins, page 243; and the dash lines in the graph are taken from Chem. Engineer's Handbook, Second Edition, page 418.

A preferred exemplary material for use to raise the specific gravity of the slurry is epsom salt. In particular, it has been found that water containing up to about 30% epsom salt will have a specific gravity of about 1.2. Thirty percent is about the maximum amount of epsom salt that can be held in slurry in water without having to elevate the water temperature. However, higher concentration will be used by raising temperature of the slurry to try load the slurry with as much epsom salt as possible. See the graphs of FIGS. 9–11 for data regarding composition and characteristics of such slurries of water and epsom salt. For example, at a temperature of 36° C. the specific gravity is about 1.35 for 30% $MgSO_4$ by weight. As an example, the slurry is formed by mixing epsom salt with water and elevating the temperature of the mixture to increase the amount of epsom salt that can be dissolved in the water than that possible at usual room ambient temperature. The slurry also can contain solid particles of epsom salt. The percent of salts are regulated by the temperature of the slurry to maintain maximum salt levels-for most efficient operation. The radiation level is monitored by a conventional monitor 48 located in the treatment station 43 and/or elsewhere in the building 11 or even outside the building 11, for example, and by adjusting the temperature of the slurry proportionally to the radiation level, salt level can be increased or decreased as a function of radiation. Preferably such proportion is in direct proportion, although such direct proportion may be nonlinear. Such temperature control and salt level can be increased or decreased as a function of radiation. Such temperature control and salt level are adjusted by operation of the heat exchanger 45, for example, which is described hereinbelow.

The use of 30% epsom salt in the water tends to reduce the freezing point of the water to about 0° F. This feature advantageously helps to avoid the possibility of the slurry 41 freezing in the pipes 23. Continuous circulation of the fluid in the pipes under the influence of the pump 42 also helps to avoid freezing. Furthermore, thermal energy generated in the building 11 by the toxic waste stored therein also helps to avoid freezing of the solution.

By using a slurry 41 that has a relatively high specific gravity, the shielding effectiveness of the slurry is enhanced. Therefore, the thickness of the roof 32 does not have to be a full three feet, which is the thickness necessary if water alone were used for radiation shielding purposes.

It is noted that sodium chloride and other salts would not be particularly useful for the function provided by the epsom salt. Sodium chloride is corrosive and would tend to destroy the pipes 23 and/or other portions of the depot 10. Epsom salt, on the other hand, is not corrosive and is non-toxic.

It is a purpose of the fluid flow system 17 to control the temperature in the space 13 of the building 11. For this purpose a heat exchanger 45 in the treatment center 43 receives fluid from the filter 44 and is able to cool the fluid and to transfer the thermal energy thereof to the environment external of the building 11. Heat from the heat exchanger is an energy source to use for other purposes, such as heating and cooling building 11, another building, or form some other purpose. The treatment center 43 may be located either inside or outside of the building 11; part may be in each location; or part or all of the treatment center may be redundantly located both inside and outside the building 11. An advantage to locating the heat exchanger or part of it outside the building is to use outside ambient temperature and/or supplemental heating or cooling provided there to control salt loading or salt level of the slurry.

The shielding effectiveness of the slurry 41 in the pipes 23 of the fluid flow system 17 preferably is approximately equivalent to the shielding effectiveness of about three feet of water and/or approximately equivalent to about three inches of lead shielding. However, the weight of the lead shielding, the environmental hazard of the lead in general, the weight and containment requirements for three feet of water, and so on are not required in the present invention. Rather, the pipes 23 may be included within the roof 32 and the exposed above ground sidewalls 31*a*. Pipes 23 of the fluid flow system 17 also may be included in the below ground portions 31*b* of the sidewalls and/or in the floor 30. Further, the pipes 23 may be used to conduct slurry 41 in other places in the building 11 for the purpose of generally controlling the temperature in the building. The thickness of the below ground portions 31*b* of the sidewalls and the thickness of the floor 30 need not be as great as the thickness of the roof 32 or of the above ground portion 31*a* of the sidewalls, since the ground 12 can be relied on to provide shielding function, as was described above.

In operation of the toxic waste depot 10, then, waste, such as toxic waste in general, radioactive waste in particular, etc. may be stored in the building. The pump 42 pumps slurry 41 through the pipes 23 of the fluid flow system 17. The slurry tends to prevent leakage of radiation through the roof 32 and above ground portion 31*a* of the sidewalls. The epsom salt in the slurry tends to absorb radiation. The ground 12 tends to prevent leakage of radiation to the above ground external environment or to the external environment more than several feet away from the building 11. The slurry 41 tends to remove thermal energy (heat) from the interior space 13 of the building in order to control the temperature therein. The excess heat can be conducted by the heat exchanger 45 to the environment external of the building 11 or to some other location without contaminating the external environment.

The filter 44 may be used to remove radioactive material, e.g., the epsom salt or equivalent and/or similar functioning material, from the slurry 41 and/or particulates from the slurry 41 as waste. Such waste may be placed in drums or otherwise delivered to the storage area 15 in the space 13 of the building 11.

In the filter 44 of the treatment plant 43 the slurry is cooled to cause the contaminated salt particles to drop out. The contaminated solid particles can be filtered from the slurry and then can be processed for detoxification and/or they can be stored. For such storage, for example, a settling pit 49 can be used to store the particles. Such a settling pit 49 is depicted schematically in FIG. 1. The settling pit may have at least three feet deep of water as a shield for blocking upward emission of radiation.

The slurry can be pumped into the settling pit 49, and the settling pit can serve a filtering function in addition to or alternatively to the filter 44. The slurry will remain below the water level due to the larger specific gravity of the slurry. The contaminated salt particles will precipitate out to the bottom of the pit by maintaining the temperature of the pit relatively cool, e.g., sufficiently cool to effect such precipitating function. The remaining slurry which is substantially uncontaminated can be removed from the settling pit; subsequently loaded as much as possible with epsom salt; and pumped through the flow system 17 again.

A door 50 provides an access to the interior space 13 of the building 11. The door 50 may be made of the same type of material of which the above ground portion 31*a* of the side walls is made and preferably the door also includes a portion of the fluid flow system 17 to provide for radiation shielding and for temperature control functions. The height of the door 50 preferably is adequate to provide, when open, access to a forklift vehicle or other vehicle that is used to carry into the space 13 fifty-five gallon drums 46 of toxic waste or some other size containers for storage within the space 13 of the building 11.

Figure 12:
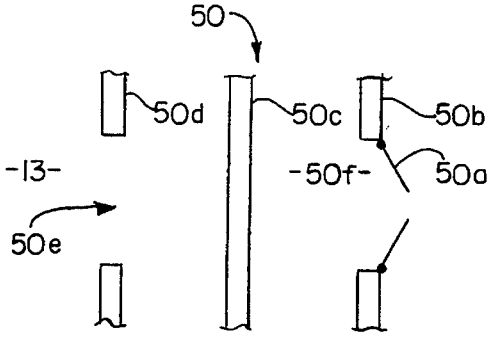
FIG. 12 is a schematic top plan view of a door to the depot building of FIG. 1 of the invention.

A top plan view of the door 50 is shown in FIG. 12. The door 50 preferably includes one or a plurality of baffle walls which provide a circuitous route into the interior 13 of the building 11 while preventing a direct path for radiation leakage through the door. As is seen in FIG. 12, the door includes an outer door 50*a* in the outer wall 50*b*, which is comprised of panels 33, for example. The outer door 50*a* can be opened for access-to the building interior 13 or closed. A baffle wall 50*c* blocks a direct path into the building interior from the door 50*a*. The interior wall 50*d* has an opening 50*e* which provides direct entrance to the interior 13. The space 50*f* between the walls 50*b*, 50*c*, 50*d* is a circuitous path between the outside ambient environment and the interior of the building. The size of the space 50*f* preferably is adequate for a vehicle to drive therealong in order to carry waste, containers, or equipment into or from the building. Each of the walls 50*b*, 50*c*, 50*d* is made of a plurality of the panels 33.

An elevator 51 includes an elevator shaft 52 and an elevator car 53 for transporting the forklift truck and/or the waste as well as individuals between various levels in the building 11. Also, a ramp 54 is provided to enable the forklift truck and/or individuals to drive or to walk between levels of the building 11. A floor 55 part way across the building or across the entire building is provided for various storage, equipment, and/or other functions as may be desired. Racks 47 for storing drums 46 or other material may be provided on one or more floors. The racks also may be used to store encased asbestos, lead painted objects, or other material.

In using the toxic waste depot 10 to store radioactive material, the radioactive material preferably is stored at the lowest levels of the building. The radiation tends to emit horizontally and perpendicularly in straight lines through the walls into the ground. The ground is a good shield and prevents the radiation from reaching other sources of water, etc. The fluid system 17 also may reduce such radiation that is emitted into the ground, depending on the extend to which slurry 41 is located in the side walls which are below ground. That radiation which tends to emit vertically is finally blocked by the slurry 41 flowing through the pipes 23 in the fluid flow system in the roof 32. Temperature in the space 13 of the building 11 is controlled by the fluid flow system and the heat exchanger 45 associated therewith so that the possibility of dangerous conditions due to high temperature in the building is avoided.

The radiation blocking and/or absorbing function of the floors of the building 11, especially the ones intermediate the bottom floor and the roof, also reduce the radiation blocking and/or shielding requirement of the roof 32. This allows the roof to have a practical thickness that will be both efficient and economical. That is, the roof can be of reduced thickness, mass, etc., compared to the requirements for roofs in prior primarily concrete storage facilities.

The building 11 provides a storage facility for nuclear and other toxic waste. The waste may be stored in drums 46. The waste and/or drums 46 may be stored in racks 47, if desired. Contaminated equipment from a dismantled nuclear plant or from a refurbished nuclear plant also may be stored in the building 11 either in a drum, on a rack, or placed on the floor of the building. Since the bottom floor 30 has maximum direct support, e.g., from the earth beneath, it is desirable to place heavier material on the bottom floor and to place less heavy material on the upper floor level(s) 55.

Additionally, as was mentioned above, the building 11 provides a place for storage of asbestos, objects painted with lead painted and/or other types of materials which have been encased in STAYTEX® material according to the disclosure of U.S. patent application Ser. No. 08/064,548. However, alternatively such encased materials can be placed directly in a conventional land fill.

The building 11 of the present invention preferably is of a modular design in that multiple panels can be used to form walls, floor and ceiling thereof. Preferably the building 11 is provided with gravity ventilation and with anti-corrosive coatings, where needed. Desirably the height between floor and ceiling permits double stacking of drums or other storage containers. Seismic fie-downs may be provided for securing the building in the event of a tremor. Concrete underground structures are suspect; they may crack. The building of the present invention using panels 33 in walls, floors and ceiling/roof is more flexible than concrete and is less subject to damage due to earth tremors than conventional concrete structures.

Other features includable in the building 11 of the invention include a fire suppression system. Desirably the various fixtures are explosion proof, such as the mechanical equipment, ventilation equipment, lighting, and HVAC system. The various parts of the building may be non-combustible having a fire rating of 1 to 4 hours. Sprinkler systems and monitoring systems for fire, gas, etc. may be provided. Exemplary toxic gas monitoring products are sold by Kern Medical Products Corp. The sumps described preferably are segregated for security and backup; and walls may be provided in the building to separate various portions. The building may be temperature controlled using appropriate HVAC equipment, and may take advantage of the heat exchanger 45 and flow system 17 of the invention, if desired. Further, if desired FM explosion relief panels may be used in the building.

It will be appreciated that in the present invention an improved building structure provides a storage depot for plutonium and nuclear waste, for example. A fluid circulation system may provide temperature control for the storage depot and also blocks transmission and absorbs nuclear radiation. Such nuclear radiation absorption may be in epsom salt which is loaded into the fluid to form a slurry. The epsom salt may be removed from the slurry and subsequently stored in the building. The fluid can be re-loaded with epsom salt for further circulation in the depot to block and to absorb additional radiation.

I claim:

1. A method of effecting radiation shielding and thermal energy removal from a toxic waste storage facility, comprising using water in combination with epsom salt to provide relatively high specific gravity slurry material to block transmission of radiation and to remove thermal energy.

2. The method of claim 1, comprising removing epsom salt from the slurry by precipitation.

3. The method of claim 1, comprising increasing the loading of epsom salt in the slurry by raising the temperature of the slurry.

4. The method of claim 1, comprising absorbing nuclear radiation in the epsom salt and removing epsom salt from the slurry to reduce the radiation level of the slurry.

5. The method of claim 4, further comprising storing the removed epsom salt in the toxic waste storage facility.

6. The method of claim 1, further comprising circulating the slurry through at least one wall, floor or roof of the toxic waste storage facility.

7. The method of claim 6, said circulating comprising circulating the slurry through a plurality of walls, a floor and the roof of the toxic waste storage facility.

8. The method of claim 7, further comprising absorbing nuclear radiation in the epsom salt and removing epsom salt from the slurry to reduce the radiation level of the slurry.

9. The method of claim 8, further comprising reloading the slurry with epsom salt and recirculating the slurry through at least one wall, floor or roof of the toxic waste storage facility.

10. The method of claim 9, further comprising storing the removed epsom salt in the toxic waste storage facility.

11. The method of claim 1, further comprising monitoring the radiation level in the toxic waste storage facility and loading an amount of epsom salt in the slurry that is proportional to the radiation level.

12. A method of removing radioactivity from the interior of a building by transporting radioactive material within a slurry and filtering out the then contaminated material outside the building, thus removing it in a continuous fluid recirculation system.

13. The method of claim 12, said filtering comprising precipitating out the contaminated material.

14. The method of claim 13, further comprising storing the precipitated out material while providing shielding of radiation.

15. A radioactive material storage facility, comprising a building having a portion located below ground level, wall means for bounding an interior space in the building, and fluid means for removing thermal energy from the building and for providing radioactive shielding at least at part of the roof of the building.

16. The facility of claim 15, said fluid means comprising pipes in walls of the building.

17. The facility of claim 15, said fluid means comprising pipes in the roof of the building.

18. The facility of claim 15 said fluid means comprising a liquid having a specific gravity greater than the specific gravity of pure water.

19. The facility of claim 15, said fluid means comprising a liquid having a specific gravity on the order of about 1.2 to about 1.6.

20. The facility of claim 15, wherein said fluid means comprises a liquid, and the facility further comprises circulating means for circulating at least a portion of said liquid.

21. The facility of claim 20, said liquid comprising water and epsom salt in slurry therewith.

22. The facility of claim 21, said epsom salt providing a maximum amount of epsom salt dissolved in the water by elevating temperature of the water above room ambient temperature.

23. The facility of claim 15, wherein said wall means comprises light weight panels.

24. A radioactive material storage facility, comprising a hole or open pit formed in ground, a building having a portion located below ground level, a liner between at least part of the building and the hole or open pit, wall means for bounding an interior space in the building, and fluid means for removing thermal energy from the building and for providing radioactive shielding at least at part of the roof of the building.

25. The facility of claim 24, said fluid means comprises a liquid, and said liquid comprises water and epsom salt in slurry therewith.

26. The facility of claim 24, wherein said fluid means comprises a liquid, and the facility further comprises circulating means for circulating at least a portion of said liquid.

27. The facility of claim 24, wherein said wall means comprises light weight panels.

* * * * *